US006244822B1

(12) United States Patent
Sinclair et al.

(10) Patent No.: US 6,244,822 B1
(45) Date of Patent: Jun. 12, 2001

(54) PRECISION CROWNING OF BLADE ATTACHMENTS IN GAS TURBINES

(76) Inventors: Glenn B. Sinclair, 4115 Bigelow Blvd., Pittsburgh, PA (US) 15213; Nathan G. Cormier, 11347 Lippelman Rd., #B 346, Cincinnati, OH (US) 45246

( * ) Notice: Subject to any disclaimer, the term of this patent is extended or adjusted under 35 U.S.C. 154(b) by 0 days.

(21) Appl. No.: 09/454,328

(22) Filed: Dec. 3, 1999

Related U.S. Application Data

(60) Provisional application No. 60/110,904, filed on Dec. 4, 1998.

(51) Int. Cl.[7] ..... B63H 1/20
(52) U.S. Cl. ..... 416/219 R
(58) Field of Search ..... 416/219 R; 29/889.7

(56) References Cited

U.S. PATENT DOCUMENTS

| | | | | |
|---|---|---|---|---|
| 4,169,694 | * | 10/1979 | Sanday | 416/219 R |
| 4,621,979 | | 11/1986 | Zipps et al. . | |
| 4,692,976 | * | 9/1987 | Andrews | 29/889.7 |
| 5,110,262 | | 5/1992 | Evans | 416/219 R |
| 5,141,401 | | 8/1992 | Juenger et al. . | |
| 5,160,242 | | 11/1992 | Brown . | |

FOREIGN PATENT DOCUMENTS

| | | |
|---|---|---|
| 1482308 | 8/1977 | (GB) . |
| 2243413 | 10/1991 | (GB) . |
| 2293212 | 3/1996 | (GB) . |
| WO8700778 | 2/1987 | (WO) . |

OTHER PUBLICATIONS

M. Ciavarella et al., "The influence of rounded edges on indentation by a flat punch", I MechE, 1998, vol. 212, Part C, pp. 319–328.

H. Poritsky, "Stresses and Deflections of Cylindrical Bodies in Contact with Application to Contact of Gears and of Locomotive Wheels", Journal of Applied Mechanics 1950, vol. 17, pp. 191–201.

* cited by examiner

*Primary Examiner*—John E. Ryznic
(74) *Attorney, Agent, or Firm*—Webb Ziesenheim Logsdon Orkin & Hanson, P.C.

(57) ABSTRACT

An improved gas turbine engine, a blade for a gas turbine for attachment to a rotor disk of the gas turbine engine and a method for manufacturing thereof. Specifically, the blade includes an airfoil attached to at least one base, wherein each of the bases is adapted to be received within a slot defined in the disk. At least one of the bases has a contacting surface for contacting a corresponding surface of the disk. At least one of the contacting surfaces is crowned.

21 Claims, 10 Drawing Sheets

PRECISION CROWNING OF BLADE ATTACHMENTS IN GAS TURBINES

CROSS REFERENCE TO RELATED APPLICATIONS

This present invention claims the benefit of U.S. Provisional Patent Application Ser. No. 60/110,904, filed Dec. 4, 1998, entitled "PRECISION CROWNING OF BLADE ATTACHMENTS".

BACKGROUND OF THE INVENTION

1) Field of the Invention

The present invention relates to gas turbine engine blades and, more particularly, to the arrangement of securing the gas turbine blades to a rotating disk.

2) Description of the Prior Art

In gas turbine engines, blades are attached to disks with dovetail or firtree attachments. A section through a prior art dovetail attachment of a base of a turbine blade 3 attached to a portion of a disk 5 is shown in FIG. 1. An airfoil (not shown) is positioned above the attachment. A section through a prior art firtree attachment is shown in FIG. 2. In the first type of attachment, a blade airfoil above the line at 7 is restrained from releasing radially by a single pair of surfaces 9 and 11 whereon it makes contact with the disk 5 at surfaces 15 and 13, respectively. As a result, dovetail attachments are sometimes termed single-tooth attachments. FIG. 2 shows a prior art firtree attachment of a base of a turbine blade 23 attached to a portion of a disk 25. The attachment includes multiple pairs of contacting surfaces 27 and 29 that contact multiple pairs of disk surfaces 31 and 33, respectively. As a result, firtree attachments are sometimes called multi-tooth attachments.

During operation, the stress fields induced by contact on surfaces 9, 11 and 13, 15; and 27, 29 and 31, 33, respectively, can fluctuate in magnitude and lead to fatigue failures in blades or disks. The costs associated with these failures are on the order of millions of dollars per year. Consequently, reducing this type of failure is highly desirable both from a safety and from an economic point of view. Hence, an object of the present invention is to provide blade attachments which offer improved resistance to this type of failure.

Focusing on dovetail attachments, FIG. 1 shows a central section through the base of the turbine blade 3 and the segment of the disk 5 that affects its attachment. As a result of high angular velocities ($\omega$) that can be involved, large radial forces F can be generated. In the attachment of FIG. 1, the force F is balanced by contact forces on two flats, $C_1C_1'$ and $C_2C_2'$. In order to keep the whole arrangement as compact as possible, the lengths of these flats are limited relative to the other dimensions of the blade. However, by making them as long as possible, the nominal normal compressive stress, $\sigma_N$, on the contacting surfaces can be kept as low as possible for a given F. A consequence of keeping $\sigma_N$ down in this manner is the use of small radii at the edges of contact, for example, at $C_1$ on the disk and $C_1'$ on the blade (labeled as r, r' in the close-up). This is also true for the out-of-plane direction as shown in FIG. 3 for a central section perpendicular to the section in FIG. 1. Small radii r", r'" present for this section occur at the edges of contact, that is near $C_3$ and $C_3'$. For all of these small radii, contact is still conforming and stresses nonsingular. However, the actual contact stress, $\sigma_c$, can have high gradients near the edges of contact. These high gradients lead to high peak $\sigma_c$ values. When slipping occurs with friction present, these high $\sigma_c$ in turn lead to large hoop stresses which are tensile in the blade at $C_1$ and the disk at $C_1'$. These tensile stresses can then open up cracks in the blade at $C_1$ and the disk at $C_1'$. With time and repeated loading these cracks can grow and ultimately give rise to failures of the attachment. Thus, reducing these tensile hoop stresses at the edges of contact can be expected to alleviate the problem of attachment failure. Hence, an object of the present invention is to reduce the tensile hoop stresses at the edges of contact in blade attachments.

Because the tensile hoop stresses are largely caused by frictional shear stresses in the contact regions, one arrangement for reducing the hoop stresses is to lower the coefficient of friction for the contacting surfaces. To this end, one practice used in the gas turbine industry is to introduce a layer of intervening material between the contacting surfaces. The material is chosen so as to facilitate slip between the blade and the disk and thereby reduce friction. It is believed that problems of attachment failure persist in the industry today even with the introduction of such intervening layers.

U.S. Pat. No. 5,110,262, which is incorporated by reference, shows an arrangement of reducing stresses at the edges of contact. This arrangement consists of making one of the in-plane contact surfaces barreled (see FIG. 3 of U.S. Pat. No. 5,110,262). This barreling reduces the peak contact stress in this plane, thus attendant shear stresses and hoop stresses. However, the height of the barreling is sufficiently large that contact with elastic stresses extends over less than half of the length of the flats (e.g., FIG. 3 of U.S. Pat. No. 5,110,262, which shows an elastic contact extent which is less than one quarter of the flats). As a result, $\sigma_N$ is increased by this arrangement. This leads to plastic flow and a redistribution of the contact stress over a larger portion of the flats. This elasto-plastic stress distribution has higher contact stresses near the edges of contact than a purely elastic or Hertzian distribution. Moreover, there is no reduction of the peak stresses near the edges of contact in the out-of-plane direction. Thus, the reduction in peak stresses near all the edges of contact afforded by the means in U.S. Pat. No. 5,110,262 is limited.

U.S. Pat. No. 5,141,401, which is incorporated by herein reference, teaches reducing peak stresses near the edge of contact in blade attachment as a way of alleviating fatigue failure. The arrangement disclosed by U.S. Pat. No. 5,141,401 to affect this end is to undercut the disk near $C_1'$ in FIG. 1. This patent discloses a demonstration of reduced stresses at this location as a result of such undercutting. However, if contact occurs at the break point where the undercut is initiated, stresses can be expected to be higher than without undercutting. Moreover, no arrangement is put forward for reducing peak stresses in the blade at the edge of contact near $C_1$, nor are any arrangements put forward for reducing such stresses in the out-of-plane direction. Thus, the reduction in peak stresses near all the edges of contact afforded by the means of U.S. Pat. No. 5,141,401 are limited.

SUMMARY OF THE INVENTION

The present invention is a blade for a gas turbine for attachment to a rotor disk. The blade includes an airfoil attached to at least one base, wherein each of the bases is adapted to be received within a slot defined in the disk. At least one of the bases has a contacting surface for contacting a corresponding surface of the disk, wherein the contacting surface includes a curved surface which includes a height from a plane defining a flat surface. The plane is defined by two orthogonal axes, wherein the height is defined along an axis normal to orthogonal axes and wherein the height varies along both the orthogonal axes. Preferably, the contacting surface varies along an in-plane axis and an out-of-plane axis. For an in-plane cross section of the contacting surface, the contacting surface extends along the in-plane axis and at least a portion of the contacting surface extending along the in-plane axis is curved. For an out-of-plane cross section of the contacting surface, the contacting surface extends along the outer plane axis normal to the in-plane axis and at least a portion of the contacting surface extending along the out-of-plane axis is curved. Preferably, the curved portions of the contacting surface are defined by arcs of a circle and at least fifty percent of the contacting surface available for contact on central sections is in contact with the corresponding surface of the disk during maximum loading in normal operation of the blade. Preferably, the blade has a plurality of contacting surfaces and each of the contacting surfaces is adapted to contact a corresponding surface of the disk, and each of the contacting surfaces includes curved portions. Preferably, the shape of the contacting surface is determined so that the normal operating stresses stay within elastic limits of the blade and corresponding disks. Preferably, the in-plane normal contact stresses act in a Hertzian-like manner. Preferably, a cross section of the out-of-plane contacting surface includes either a single circular arc or two circular arcs positioned on opposite ends of a flat line or approximate flat line. Preferably, the central height of the out-of-plane curve is such that the normal operating stresses in the out-of-plane are within the elastic limits of the blade and the disk.

The present invention is also a gas turbine engine having a plurality of blades attached to a disk, wherein each of the blades includes an airfoil attached to a base and each of the bases is adapted to be received in a slot defined in the disk. Each respective slot and base has a respective slot contacting surface and a base contacting surface adapted to contact each other during rotation of the disk. At least one of the respective base contacting surface and slot contacting surface is curved relative to the other. Preferably, one of the base contacting surface and disk contacting surface is a curved surface and includes a height from a plane defining a flat surface. Alternatively, both the base contacting surface and respective slot contacting surface can be curved. The plane is defined by two orthogonal axes, wherein the height is defined along an axis normal to the orthogonal axes and wherein the height varies along both orthogonal axes. Portions of the base contacting surface and the slot contacting surface are defined by circular arcs and straight lines when in-plane and out-of-plane cross sections are taken of the contacting surfaces.

The present invention is also a blade for a gas turbine for attachment to a rotor disk that includes an airfoil attached to at least one base, wherein each of the bases is adapted to be received within a slot defined in the disk. At least one of the bases has a contacting surface for contacting a corresponding surface of the disk, wherein the contacting surface includes a curved surface that includes a height from a plane defining a flat surface. The plane is defined by two orthogonal axes and the height is defined along an axis normal to the two orthogonal axes. The height varies along at least one of the orthogonal axes so that normal operating stresses stay within elastic limits of the blade and the corresponding disk and in-plane normal contact stresses act in a Hertzian-like manner.

The present invention is also a method for manufacturing a gas turbine rotor disk blade base receiving slot and a base of a turbine blade for receipt in the slot, wherein the blade includes an airfoil attached to at least one base, wherein each of the bases is adapted to be received in the respective blade receiving slot defined in the disk, and each respective slot and base having a respective slot contacting surface and a base contacting surface adapted to contact each other during rotation of the disk, and wherein at least one of the respective slot contacting surface and the base contacting surface is crowned, the method comprising the steps of:

a) performing an in-plane stress analysis and out-of-plane stress analysis of a respective base contacting surface profile and a slot contacting surface profile for a first crown profile;

b) adjusting the crown profile so that under normal operating conditions at maximum load, at least fifty percent of the crown profile available for contact in both the in-plane central section and the out-of-plane central section contacts the respective base contacting surface or slot contacting surface, and normal operating stresses of the respective slot contacting surface and base contacting surface are elastic; and c) machining the slot contacting surface and the blade contacting surface pursuant to the adjusted crown profile.

The method can include providing the crown profile on either the slot contacting surface or the blade contacting surface, or providing crown profiles on both the disk contacting surface and the blade contacting surface.

The method can further include providing an in-plane profile and an out-of-plane profile that are defined by circular arcs. The method can further include an in-plane profile that provides in-plane normal contact stresses to act in a Hertzian-like manner under normal operating conditions and the out-of-plane profile can be defined by two circular arcs positioned on opposite ends of a flat line or a nearly flat line. The method can further include performing the in-plane stress analysis and out-of-plane stress analysis simultaneously with a three-dimensional stress analysis.

DESCRIPTION OF THE PREFERRED EMBODIMENTS

As stated previously, an object of the present invention is to reduce the stresses occurring near the edges of contact in blade attachments and thereby improve the fatigue life for these components. Before describing the preferred embodiments chosen to affect this end, the physics of the type of failure involved needs to be explained further.

During loading up to a high speed of rotation of the disk and blade, the blade can be shown to slip out radially relative to the disk. A simple spring model of the blade and disk which accounts for lateral deformation shows that such a slip occurs when $$\tan \alpha > \mu, \quad \text{(Equation 1)}$$

where $\alpha$ is the angle of inclination of the flats (FIG. 1), and $\mu$ is the coefficient of friction. Typically in the gas turbine industry, $\alpha$ is of the order of forty-five degrees and tan $\alpha$ therefore about 1, whereas $\mu$ is less than ½. Hence, Equation 1 holds and slip occurs.

Figure 4:
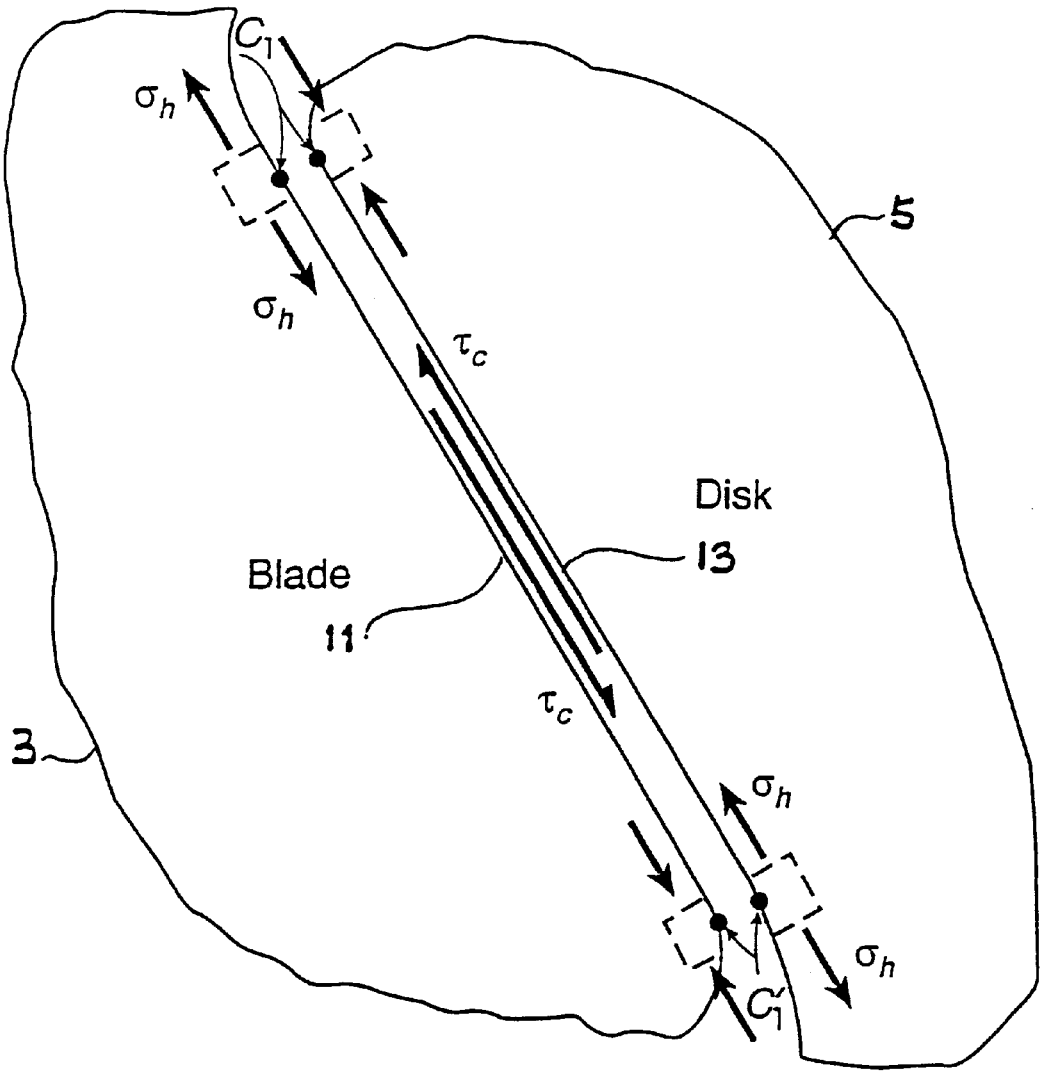
Fig.4 PRIOR ART
FIG. 4 is an elevational view of a portion of the arrangement shown in FIG. 1 showing a representation of contact shear stresses and attendant hoop stresses.

This slip produces a contact shear stress $\tau_c$. This shear stress acts inwards on the blade, outwards on the disk. The directions of $\tau_c$ are shown in FIG. 4 which depicts an exploded view of the contacting surfaces on the right-hand side of FIG. 1, with the surfaces separated to enable $\tau_c$ to be inserted. The magnitude of $\tau_c$ is governed by Amonton's or Coulomb's law and is given by $$\tau_c = \mu \sigma_c. \quad \text{(Equation 2)}$$

Thus, the actual distribution of contact shear parallels that of the normal contact stress.

The presence of the contact shear induces hoop stresses $\sigma_h$ in the blade and disk. These stresses are tensile behind $\tau_c$ where material is being pulled, compressive ahead of $\tau_c$ where material is being pushed (FIG. 4). Thus, they are tensile in the blade at $C_1$, and tensile in the disk at $C_1'$. Hence, in these two locations, they act to pull apart material and open up cracks. Furthermore, at the edge of contact they are large in magnitude, being comparable to peak $\sigma_c$. To gain a better appreciation of the sources of these edge of contact stresses, corresponding nominal values are next estimated then multiplied by appropriate stress concentration factors.

Figure 1:
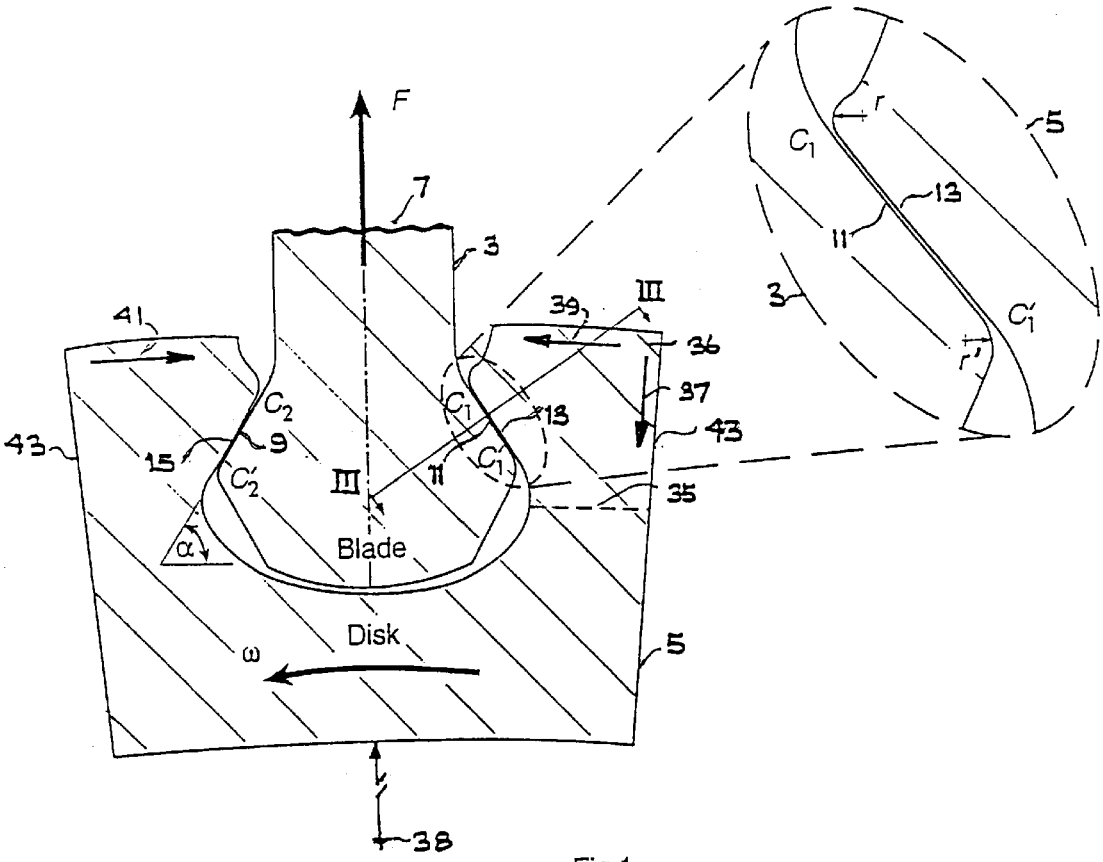
Fig.1 PRIOR ART
FIG. 1 is an elevational view of a prior art central in-plane section through a dovetail attachment of a base of a turbine blade and a portion of a disk of a gas turbine engine, with a close-up showing local radii of curvature near the edges of contact.
Figure 5:
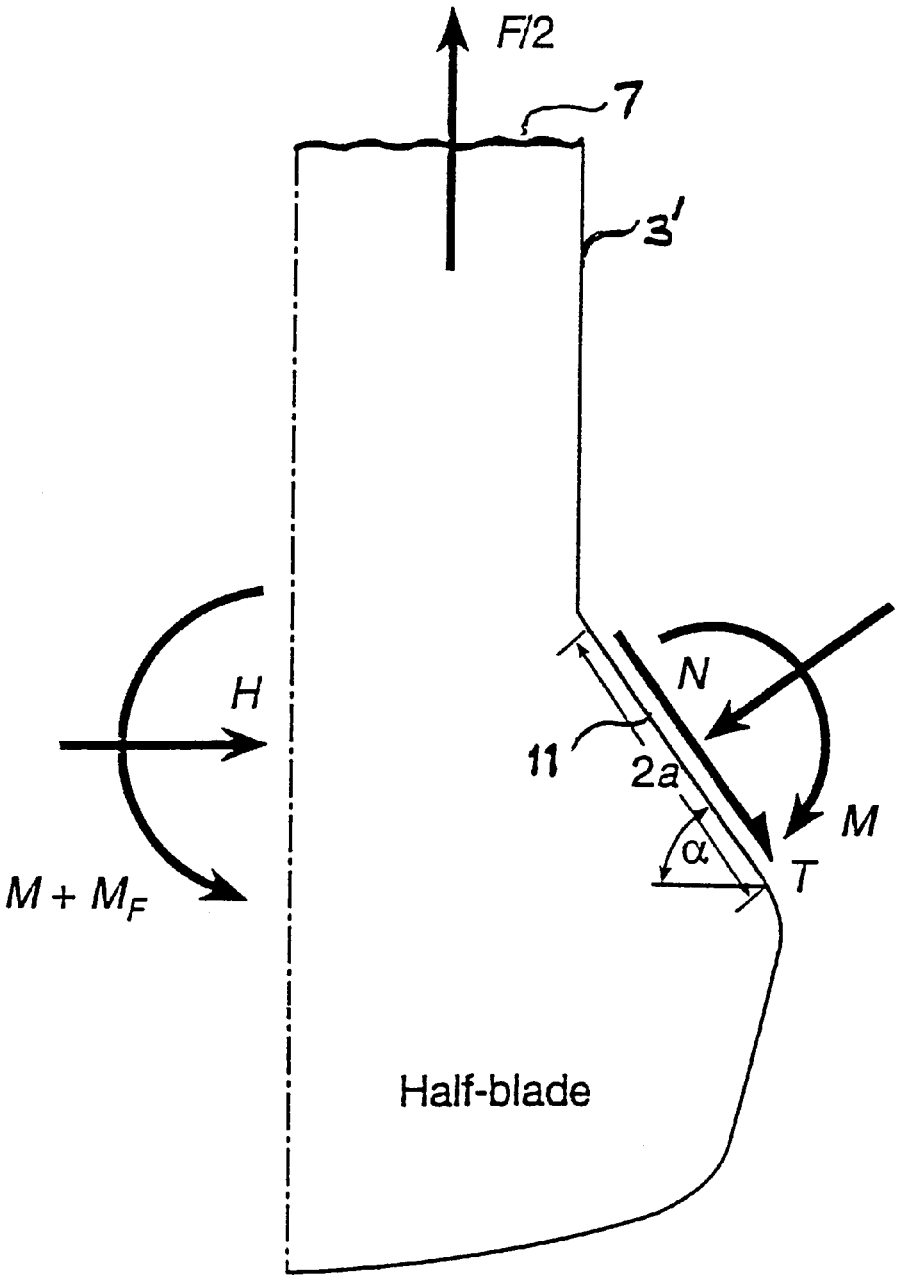
Fig.5 PRIOR ART
FIG. 5 is a free-body diagram of half of the in-plane blade section shown in FIG. 1.

The nominal stresses follow from the free-body diagram in FIG. 5 for half of the in-plane blade section of FIG. 1. The share of the loading of this half blade F/2 comes from the centripetal acceleration of its self mass and that portion of the blade not shown in FIGS. 1 and 5. This load is balanced by normal and shear forces, N and T, acting on a contact region of extent 2a inclined at an angle of $\alpha$. By virtue of symmetry, there are no counterbalancing forces on the centerline and only a horizontal force there, H. In general, there can be a moment reaction M on the contact region. This is balanced by an equal and opposite moment on the centerline, which also has a further moment $M_F$ to offset the moment produced by F/2 about the head of N. All of these stress resultants are per unit length in the out-of-plane direction in FIG. 5.

Resolving vertically in FIG. 5 gives:

$$F/2 = N \cos \alpha + T \sin \alpha. \quad \text{(Equation 3)}$$

Given the slip already noted to occur in dovetail attachments during loading up, the counterpart of Equation 2 holds for stress resultants, namely:

$$T = \mu N. \quad \text{(Equation 4)}$$

Together Equations 3 and 4 have:

$$N = \frac{F/2}{\cos\alpha + \mu \sin\alpha}. \quad \text{(Equation 5)}$$

Now the nominal normal contact stress $\sigma_N$ and nominal shear stress $\tau_N$ can be estimated from:

$$\sigma_N = N/2a, \ \tau_N = \mu \sigma_N. \quad \text{(Equation 6)}$$

The corresponding nominal bending stress $\sigma_B$ is related to the moment M as in:

$$\sigma_B = 3M/2a^2. \quad \text{(Equation 7)}$$

Unfortunately, the moment M in the configuration in FIG. 5 is statically indeterminate and thus does not admit to as ready a determination as N of Equation 5. It can however be determined via finite element analysis.

Corresponding peak values of the normal contact stress $\sigma_c^{max}$, the contact shear $\tau_c^{max}$, and the hoop stress $\sigma_h^{max}$ follow from the nominal stresses at maximum rpm (revolutions per minute) or load. The peak normal contact stress is thus given by $$\sigma_c^{max} = K_T \sigma_N + K_B \sigma_B. \quad \text{(Equation 8)}$$

In Equation 8, $K_T$ is the stress concentration factor for contact between the blade and the disk at maximum rpm without bending stresses $K_B$, the corresponding factor for bending alone. The value of $K_T$ can be estimated from the analytical solution in Ciavarella et al., *Proceeding of the Institution of Mechanical Engineers*, Vol. 212, Part C, pp. 319–328, 1998: alternatively, it can be obtained via finite element analysis. The value of $K_B$ can be obtained via finite element analysis. Given $\sigma_c^{max}$ from Equation 8, the peak contact shear then follows from $$\tau_c^{max} = \mu \sigma_c^{max}. \quad \text{(Equation 9)}$$

In Equation 9, the fact that the blade slips during loading up and Equation 2 holds for all contact shears has been applied to the peak shear. Given $\tau_c^{max}$ from Equation 9, the peak hoop stress due to friction can be estimated by $$\sigma_h^{max} \approx 2\tau_c^{max}. \quad \text{(Equation 10)}$$

In Equation 10, the factor of two (2) comes from Poritsky, American Society of Mechanical Engineers, *Journal of Applied Mechanics*, Vol. 17, pp. 191–201, 1950. So too does the location of $\sigma_h^{max}$ which is right at the edge of contact. The factor of two (2) is exact for the Hertzian contact treated in the Poritsky reference, and approximate for the contact stress distributions which act here, as may be verified via finite element analysis. The location of $\sigma_c^{max}$ is the same in the Poritsky reference and the blade-disk contact, as may be verified via finite element analysis.

After reaching maximum rpm and consequent maximum loading, some unloading typically occurs in gas turbine engines. With unloading, F→F, ΔF where ΔF is the reduction in the force F of FIG. 1. This unloading can be small (ΔF/F<<1), such as that which attends small fluctuations in engine operating conditions. These small fluctuations can occur frequently and lead to high cycle fatigue damage. Alternatively, unloading can be quite significant (e.g., ΔF/F=¼), such as that which attends plane maneuvers. These load variations can occur far less frequently but can lead to low cycle fatigue damage. The key, then, to understanding the physical mechanisms in the fatigue of blade attachments is understanding what happens to the tensile hoop stresses during unloading.

For either type of unloading, there is a reduction in the load carried in the disk at sections, such as identified at section 35 in FIG. 1. This causes these sections of the disk to attempt to spring back. This in turn causes portions 36 of the disk positioned above 35 to attempt to move radially inwards as designated by arrow 37. By radially inwards, it is meant toward the center 38 of rotation of the disk. Accompanying this radial inward motion is a circumferential contraction as shown by arrows 39 and 41. This is because the base of the blades 3 is periodically spaced around the circumference of the disk 5 they are attached to and thus the outer sides 43 of the disk 5 segment shown in FIG. 1 project radially inwards to the center of the disk and are not parallel. With this contraction, the disk 5 pinches the base of blade 3 if the two stick together. By sticking to, it is meant that there is no slipping or relative radial motion between the contacting surfaces. Such sticking and pinching actually increases $\sigma_c$, the normal contact stress. As a result, the shear contact stress $\tau_c$ must reduce. This is because, together, $\tau_c$ and $\sigma_c$ support the reduced radial force F−ΔF, and $\sigma_c$ is increasing with this reduction, so $\tau_c$ must drop to compensate both the drop in F and the increase in $\sigma_c$. Since the hoop stress $\sigma_h$ is largely a product of $\tau_c$, it too must drop. The same drops also occur in $\tau_c^{max}$ and $\sigma_h^{max}$. Moreover, with the increase in $\sigma_c$ the contact area expands so that the location with the tensile $\sigma_h^{max}$ during loading up can move from just at the edge of the contact region during loading to just inside during unloading. Thus, tensile $\sigma_h^{max}$ at this location can change and become compressive.

To see better how sticking during unloading when friction is present is consistent with an increase in normal contact stress, consider what happens to the tangential resultant under these circumstances. Thus, reconsider the free body diagram of a half blade 3' shown in FIG. 5 with $$F/2 \rightarrow F/2-\Delta F/2,\ N \rightarrow N+\Delta N. \qquad \text{(Equation 11)}$$

In Equation 11, ΔF is positive because of the unloading, ΔF/2 is the share of this unloading for the half blade 3', and ΔN is positive under the assumption of an increase in normal contact stress. Now resolving vertically gives $$F/2-\Delta F/2=(N+\Delta N)\cos\alpha+(T+\Delta T)\sin\alpha. \qquad \text{(Equation 12)}$$

In Equation 12, ΔT is the change in the tangential resultant due to unloading. Using the relation between F/2, N and T of Equation 3, Equation 12 gives $$\Delta T=-(\Delta F/2)\csc\alpha-\Delta N\cot\alpha. \qquad \text{(Equation 13}$$

Hence, ΔT is negative and T is reduced on unloading. Because T=$\mu$N at maximum load, it follows that $$T+\Delta T<\mu(N+\Delta N) \qquad \text{(Equation 14)}$$

on unloading, since the left-hand side is smaller than T while the right is larger than $\mu$N. The inequality in Equation 14 is the condition for sticking in Amonton's or Coulomb's law. Accordingly, an increase in N on unloading is consistent with sticking and pinching.

Equation 13 also explicitly shows the two sources of reduction in tangential resultant and hence contact shear which accompany unloading. The first is the expected reduction because there is less load to be balanced—the ΔF term in Equation 13. The second is the reduction occurring because the normal reaction has increased and consequently is balancing a greater share of the load—the ΔN term in Equation 13. These reductions lead to corresponding reductions in $\tau_c$ and $\tau_c^{max}$, hence $\sigma_h^{max}$ of Equation 10.

With the increase in normal contact stresses that accompanies unloading with pinching, there is the previously noted possibility of the location of tensile $\sigma_h^{max}$ at the edges of contact moving to within the contact region and the hoop stress becoming compressive there. Whether this occurs depends on the magnitude of ΔF/F. Again, the actual determination of the magnitudes of all of the stresses involved can be made with finite element analysis.

Figure 3:
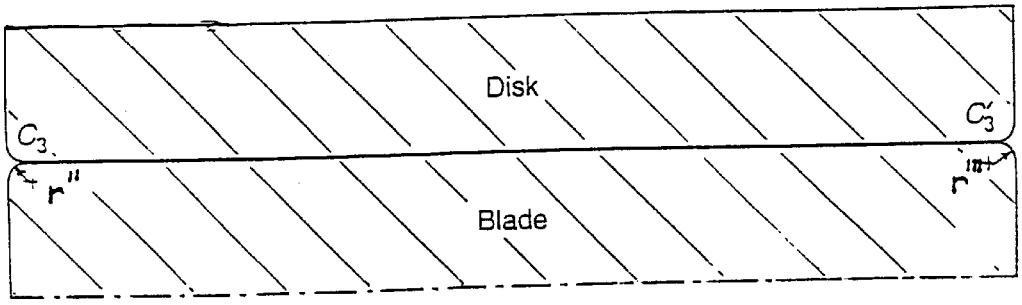
Fig.3 PRIOR ART
FIG. 3 is a section taken along lines III—III of FIG. 1.
Figure 2:
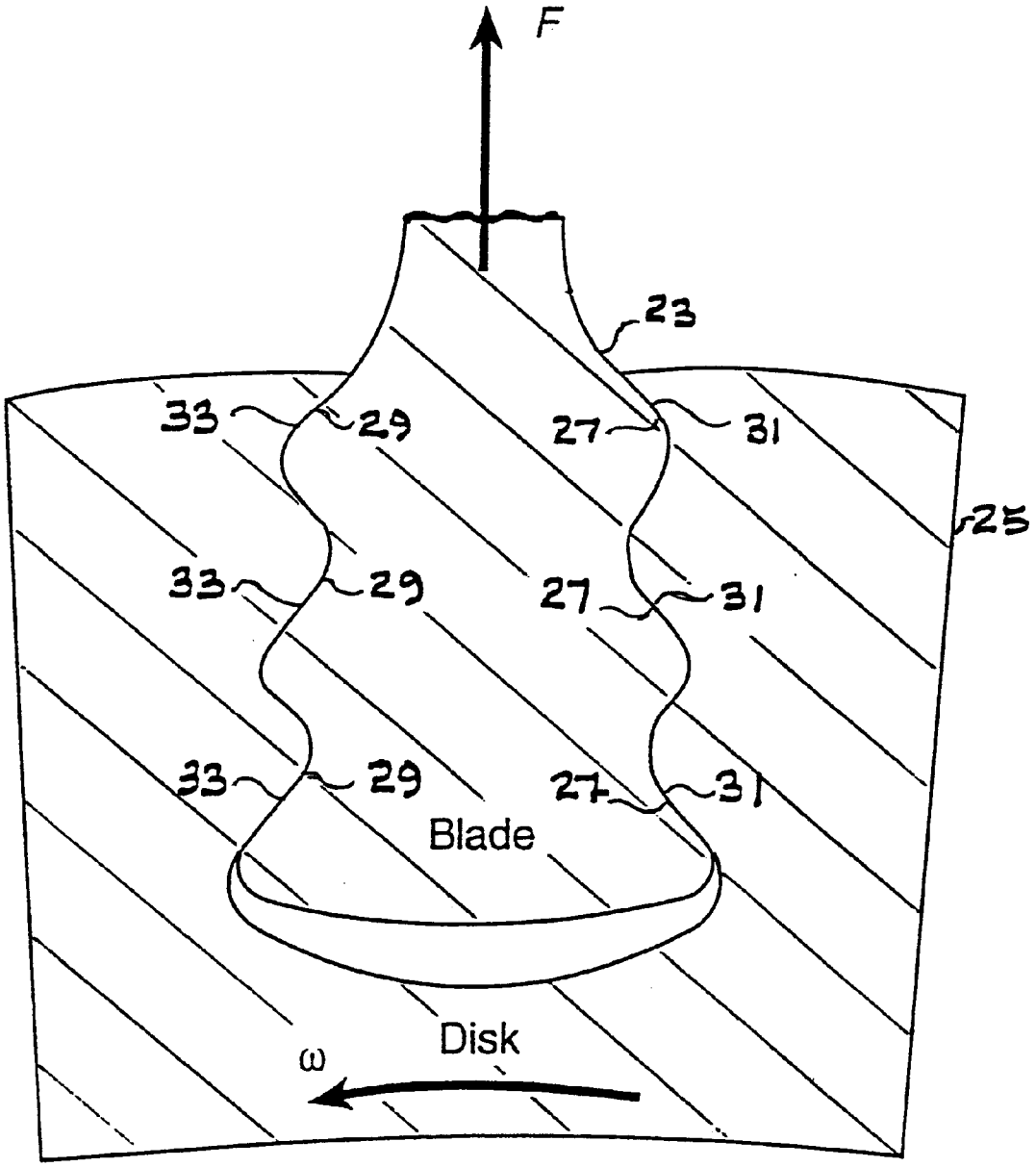
Fig.2 PRIOR ART
FIG. 2 is an elevational view of a prior art central in-plane section through a firtree attachment of a base of a turbine blade and a portion of a disk of a gas turbine engine.

Hence, in view of the foregoing small oscillations in blade loads can produce relatively large variations in tensile hoop stresses. The greatest of these variations occurs at points like $C_1$ in the base of blade 3 and $C_1'$ in the disk 5, and near the edges $C_3$, $C_3'$ of the corresponding out-of-plane section as shown in FIGS. 1 and 3. These large oscillations in tensile stress promote the opening up of small fatigue cracks at such locations. With time and further load cycles, these cracks can grow and lead to the ultimate failure of the blade attachment.

To reduce the possibility of such fatigue failures, the following strategy is adopted. The strategy is to reduce $\sigma_c^{max}$, hence $\tau_c^{max}$, hence corresponding tensile $\sigma_h^{max}$ during loading up. Thus, there is less tensile stress to be reduced by pinching, and smaller oscillations in $\sigma_h$ result. Since just small drops in the magnitudes of oscillations in stresses can produce significant increases in fatigue life, the strategy offers the possibility of greatly improved resistance to fatigue for blade attachments.

In implementing the strategy, the stress concentration factors for both in-plane and out-of-plane geometries are lowered while keeping nominal stresses comparable to their original values. This lowers peak $\sigma_c$. The present invention reduces stress concentration factors through precision crowning. By precision crowning it is meant crowning in both in-plane and out-of-plane directions which reduces concentration factors, yet is precisely controlled enough to ensure contact on preferably at least fifty percent of the central extents in both directions at maximum load. In addition, this crowning is to be controlled enough that stresses at maximum load remain in the elastic regime, at least in large part.

Figure 6:
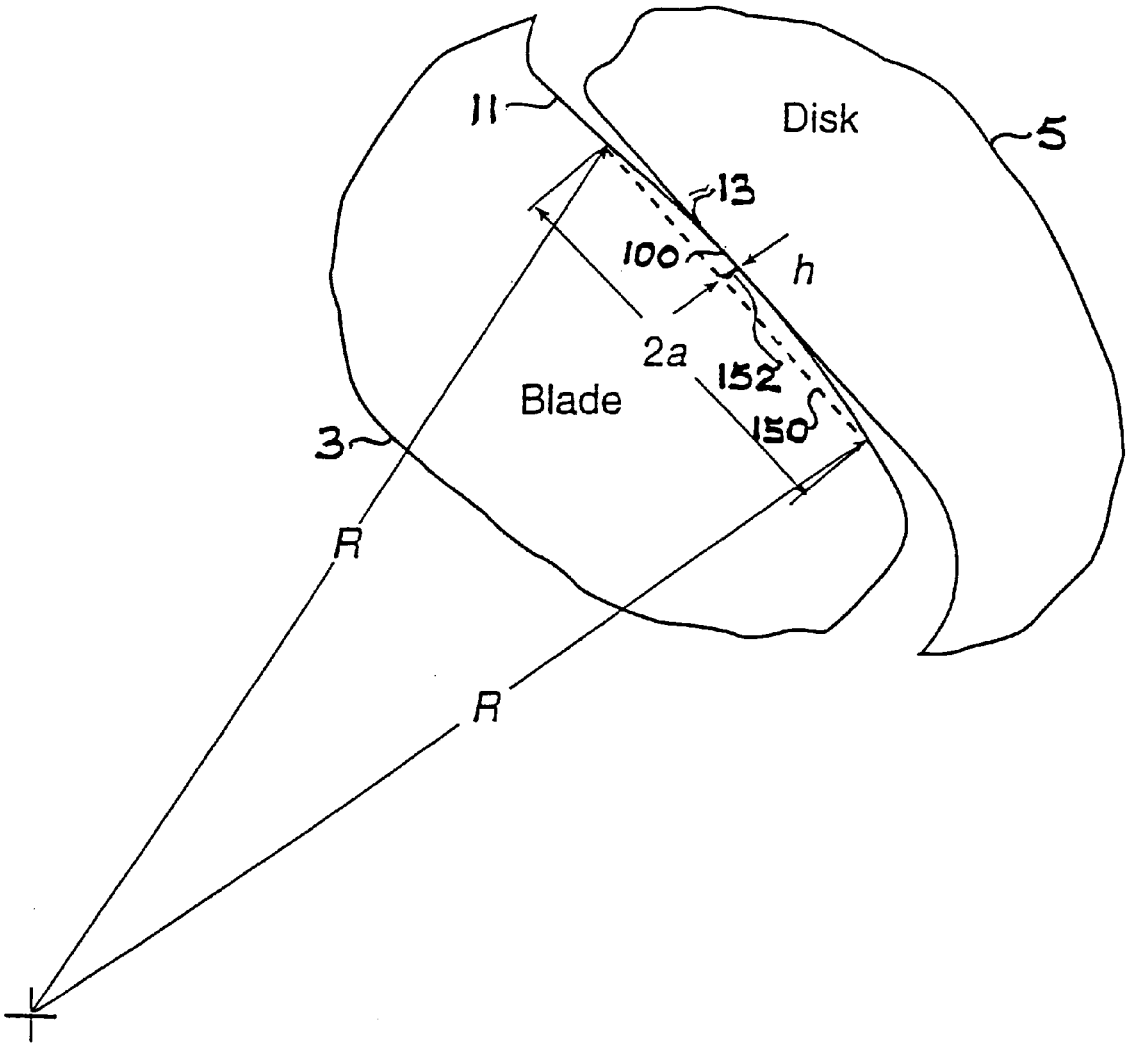
FIG. 6 is an elevational in-plane view of a dovetail attachment made in accordance with the present invention where the dovetail includes a crowning profile.
Figure 8A:
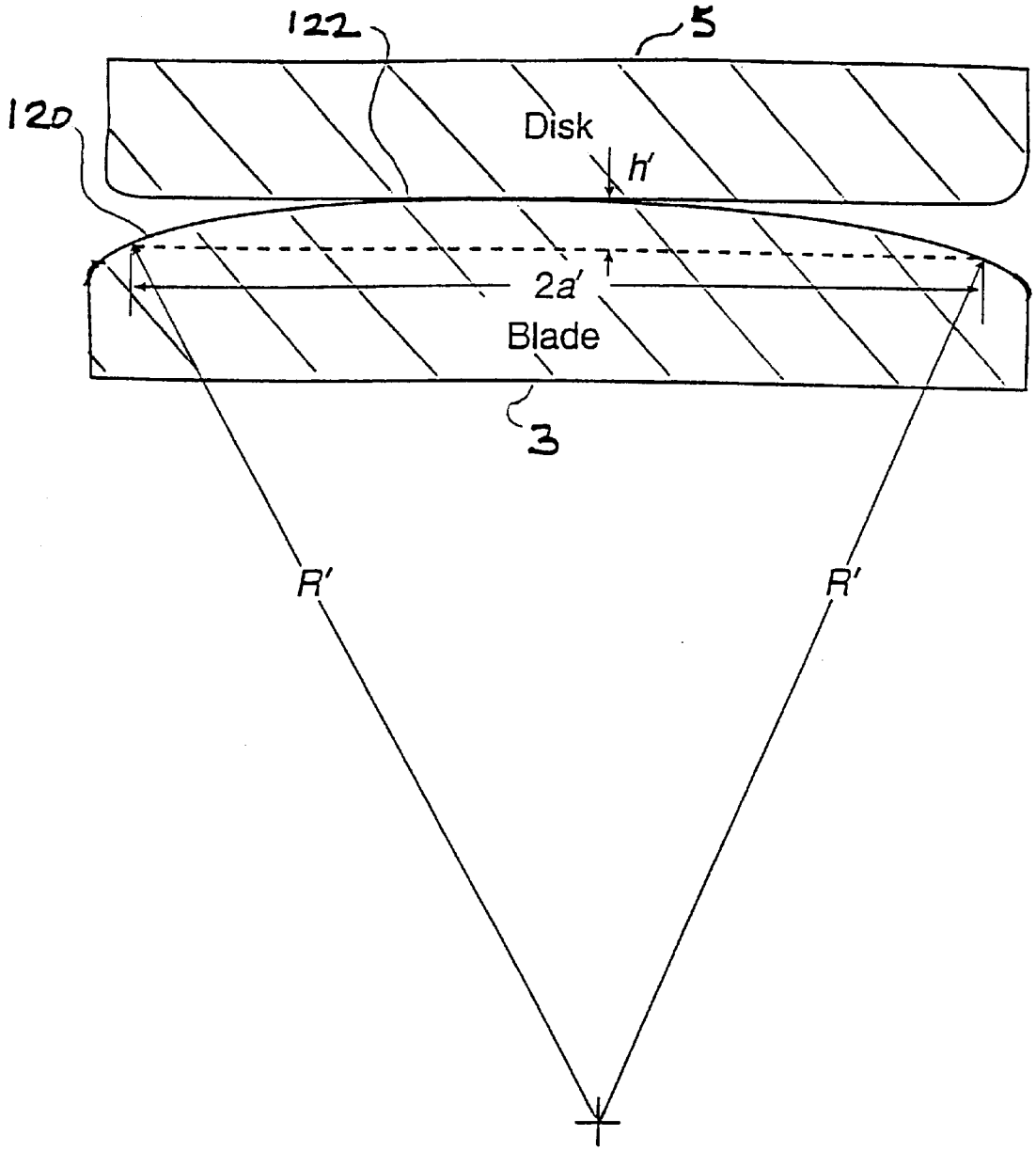
FIGS. 8(*a*) and 8(*b*) are sectional out-of-plane views of dovetail attachments made in accordance with the present invention showing crowning profiles.
Figure 8B:
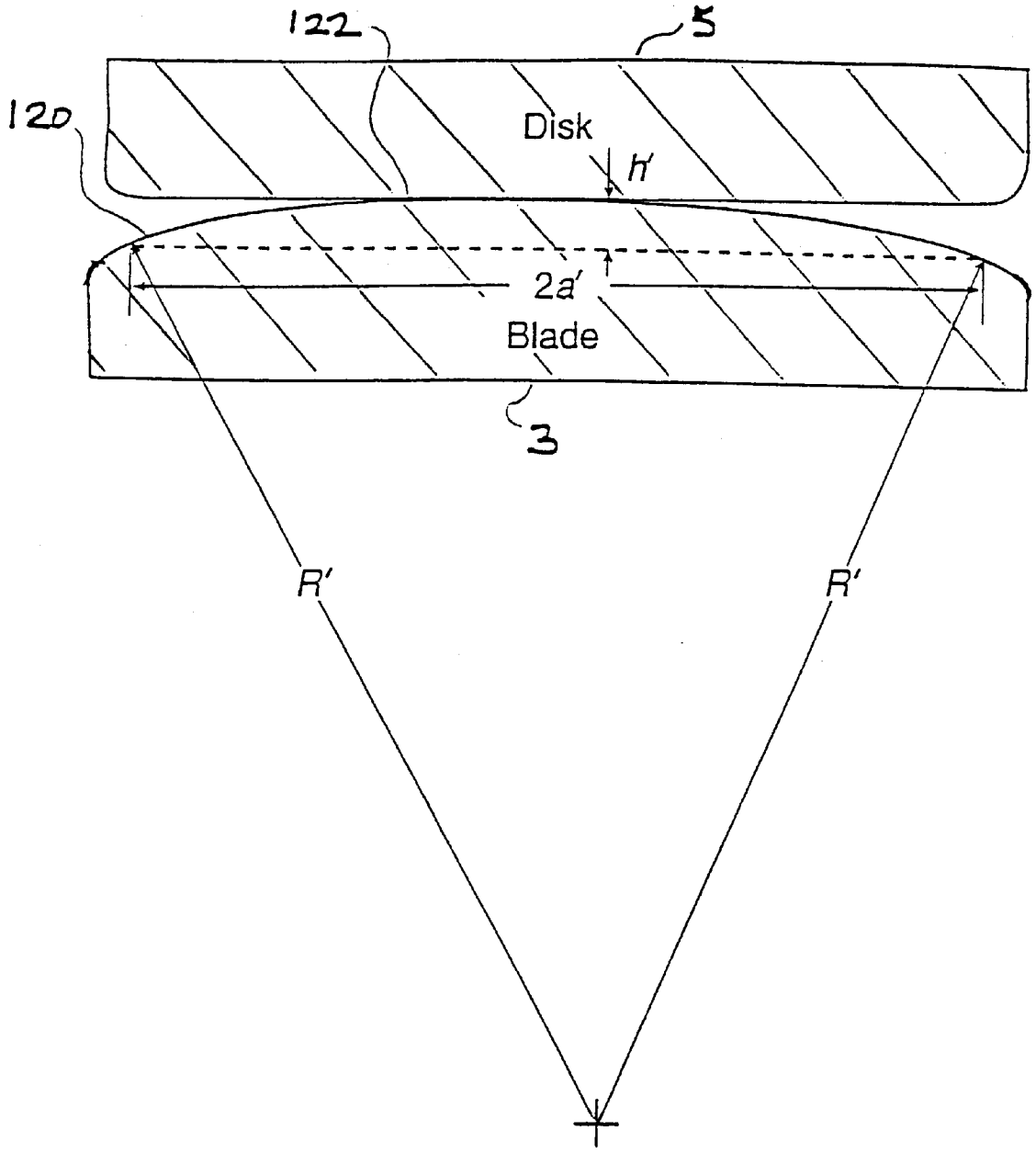
Figure 8B:
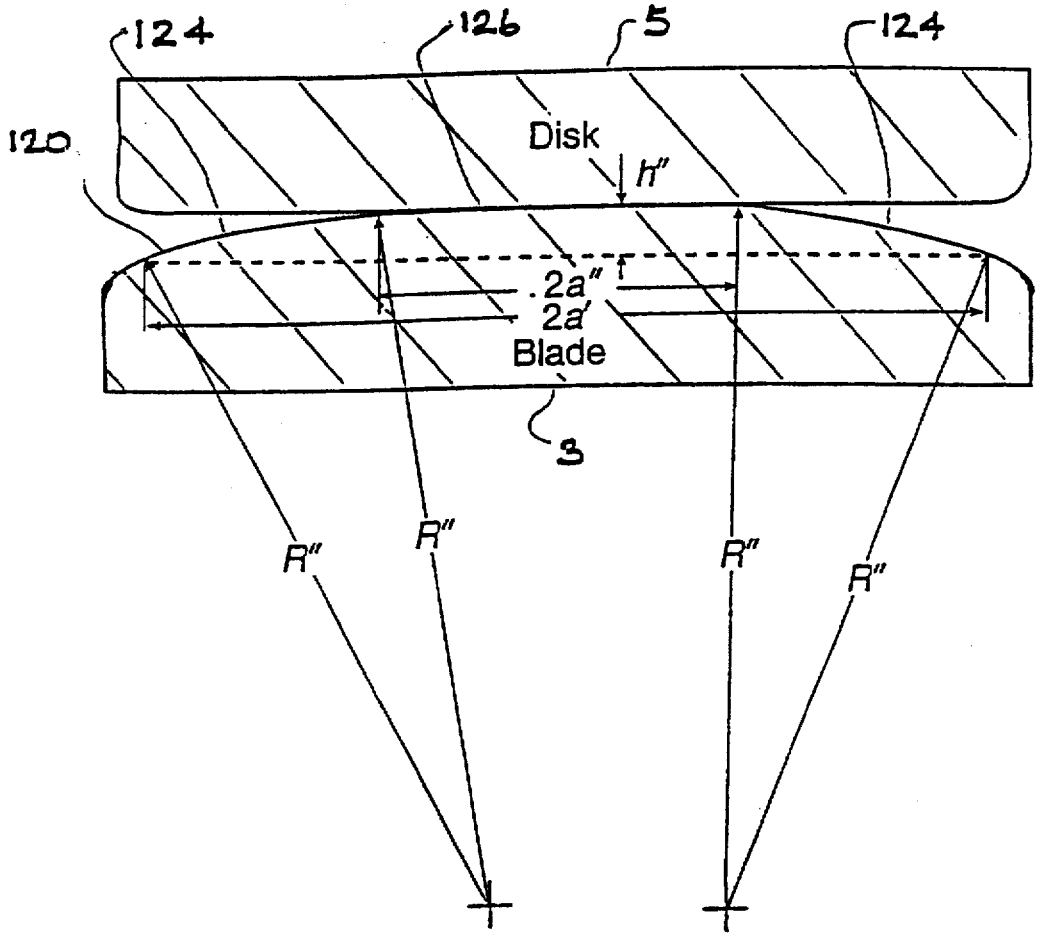

In view of the foregoing, the present invention is shown in FIGS. 6 and 8(*a*) and (*b*). As shown in FIG. 6 for the in-plane direction, the crowning is defined by a circular arc or crown 100 having a radius R smoothly blended into the original contact flat surface 11. This crown 100 leads to a height h above the original flat surface 11 which is shown greatly amplified in FIG. 6 for clarity. The extents of the in-plane flat surface 11 available for crowning are typically small, relative to the other dimensions of the blade, such as the blade length. In general, for such small extents at low load levels, the crown heights, so that elastic contact spreads preferably over at least fifty percent of the surface available, can be so small as to be not machinable. In blade attachments, however, load levels are high, and resulting crown heights h are capable of being manufactured with precision machining techniques known in the art. The crown 100 defines the new contacting surface.

The crowning 100 in FIG. 6 can be applied to the disk 5 instead of the base of blade 3, or even to both the base of the blade 3 and the disk 5. All such crowns 100 are smoothly blended into original geometries. In addition, if the crown 100 is on the disk 5 alone, its height h continues to be adjusted so that elastic contact spreads preferably over at least fifty percent of the available surface 11. Similarly, if both the base of blade 3 and disk 5 are crowned, the total of the crown heights is adjusted so that elastic contact spreads preferably over at least fifty percent of the available surface for contact.

An initial estimate of the in-plane crown height h can be made using classical formulae for Hertzian contact. This leads to lower bound on h, for contact over the entire extent of 2a, given by $$h > \frac{2N}{\pi E}. \qquad \text{(Equation 15)}$$

In Equation 15, N is the normal resultant at maximum load and E is the Young's modulus of elasticity for the contacting surfaces. From Hertz theory, E is given by $$E = \left[\frac{1-\nu_b^2}{E_b} + \frac{1-\nu_d^2}{E_d}\right]^{-1}. \qquad \text{(Equation 16)}$$

In Equation 16, $E_b$ and $E_d$ are the Young's moduli for the blade and the disk, respectively, while $\nu_b$ and $\nu_d$ are corresponding Poisson's ratios.

To test the in-plane crowning shown in FIG. 6, a finite element analysis of an in-plane section of a dovetail attachment was performed. Such a finite element analysis must be capable of tracking the expanding contact that attends the pushing together of the conforming surfaces in dovetail attachments. Elements which are capable of this tracking are currently available in standard, commercial, finite element codes. Such a finite element analysis should also be of sufficient refinement to ensure truly converged stresses near the edges of contact are obtained. One means of ensuring a finite element grid of sufficient refinement is to use submodeling which is known in the art.

For a titanium blade and disk loaded up to a maximum of nine thousand (9000) rpm, test results show that for a flat with 2a=⅕ inch, in-plane heights h in the range of 0.004 inches to 0.001 inches result in elastic contact over fifty to one-hundred percent of the surface available for contact for a central section. Consequently, there is some tolerance in manufacturing crown heights h.

Figure 7:
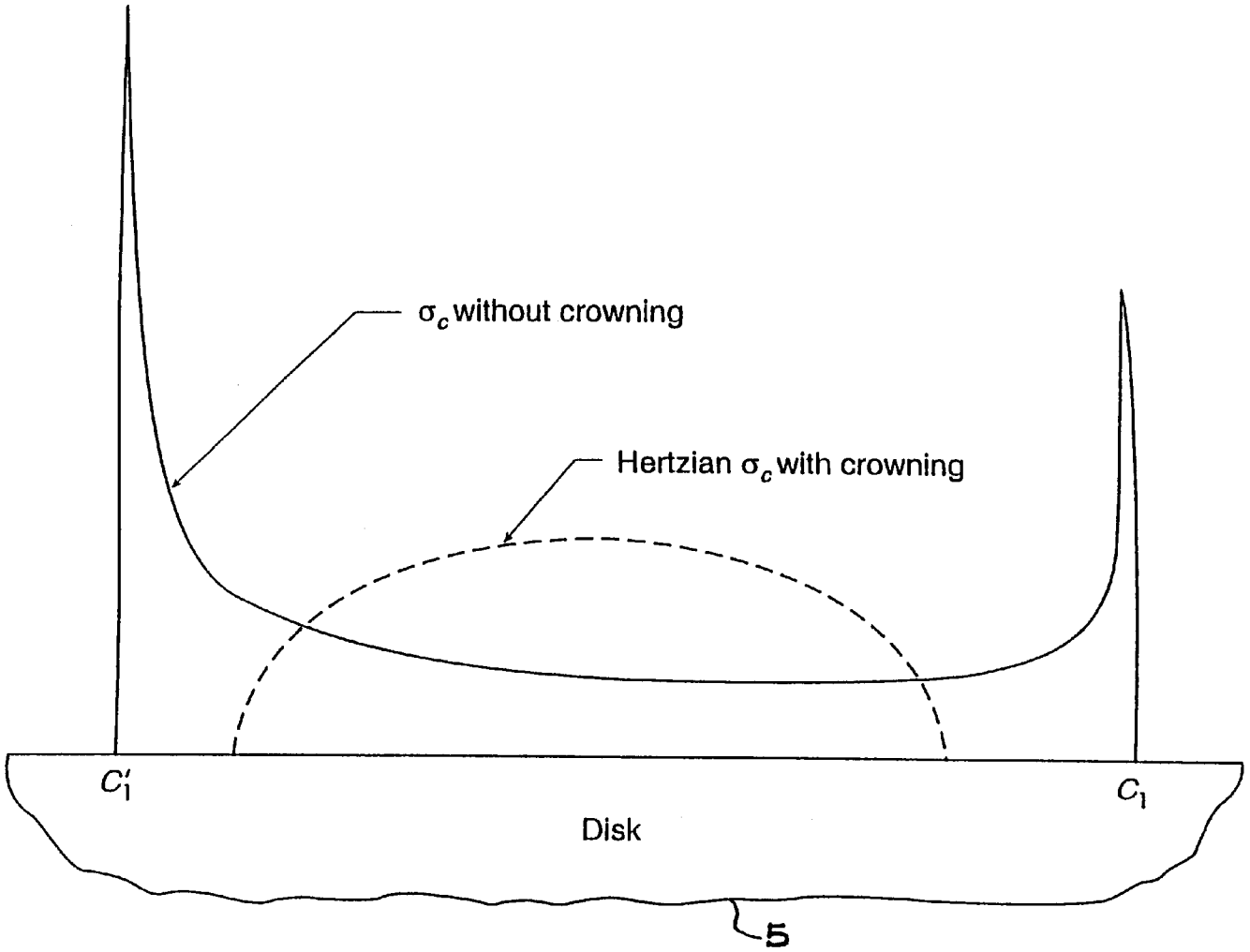
FIG. 7 is a graphic representation of finite element test results for the effects of crowning the central in-plane section shown in FIG. 6.

The test results also demonstrate that the normal contact stress distribution is improved. For a representative crown height h=0.002 inches, the contact stress distributions with and without in-plane crowning are shown in FIG. 7. The $\sigma_c$ for the prior art without crowning is shown as a solid line in FIG. 7, while $\sigma_c$ for in-plane crowning is shown as a broken line in FIG. 7. Clearly, the peak $\sigma_c^{max}$ is reduced considerably with crowning. The reduction in $\sigma_c^{max}$ with crowning results from maintaining comparable nominal stresses at maximum load while reducing contributions from stress concentrations.

With respect to in-plane nominal stresses, the finite element test results show the following. First, with crowning the finite element results converge to a $\sigma_c$ distribution which is indistinguishable from a Hertzian distribution on the scale of FIG. 7. Then, since these stresses typically extend over less of the available surface for contact, they lead to a larger nominal contact stress. That is, for h=0.002 inches and a crown profile as in FIG. 6, $\sigma_N^{crown}$=1.44 $\sigma_N$, or a forty-four percent increase. On the other hand, since Hertzian contact stresses are symmetric, there is no bending contribution. That is, $\sigma_B^{crown}$=0. In this sense, overall nominal stresses are comparable with in-plane crowning to those of the prior art.

With respect to in-plane stress concentrations, the finite element test results show the following. First, since $\sigma_B^{crown}$= 0, the only contribution to $\sigma_c^{max}$ of Equation 8 when in-plane crowning is used comes from $K_T^{crown}$, with crowning and thus a Hertzian contact stress distribution, $K_T^{crown}$= 1.3. For the prior art contact stress shown in FIG. 7, $K_T$=4.9. Hence, $K_T$ is reduced by more than a factor of three by in-plane crowning. Furthermore, the prior art has the stress concentration associated with $K_B$ of Equation 8, whereas with in-plane crowning there is no such contribution.

Similar reductions in stress concentration contributions occur for h in the range of 0.001–0.004 inches. For h less than 0.001 inches, elastic contact spreads off the circular arc in the crown in the test configuration. Then, additional stress concentrations start to occur near the edges of contact. To avoid this, crown heights h for in-plane crowning should, in general, be large enough so that elastic contact extents remain below 2a. This is why the strict inequality was employed in Equation 15.

In all, $\sigma_c^{max}$ with in-plane crowning is reduced by more than a factor of three from the prior art for the representative crown height in the test results. This leads to the same reduction in peak contact shears via Equation 9, and a similar reduction in peak tensile hoop stress via Equation 10.

For the out-of-plane direction, crowning can be shaped analogously to FIG. 6 for the in-plane direction. Specifically, as shown in FIG. 8(*a*), a crown 120 having a circular arc 122 smoothly blended into the original contact surface. The height of the crown h' is shown enlarged in FIG. 8(*a*) for clarity. In the out-of-plane direction, the extent of the original flats 2a' can be considerably larger than that for the in-plane direction 2a. Hence, the height for out-of-plane crowning h' can be considerably larger than that for in-plane h. If needed to reduce h', an alternative crown profile can be used. This consists of two circular arcs 124 smoothly joined by a flat or nearly flat section 126 with the other ends of the arcs smoothly blended into the original contact surface resulting in a height h" as shown in FIG. 8(*b*). By nearly flat, it is meant the radius of curvature of the section 126 is large relative to the radius of curvature of the circular arcs 124. Again, the height of the crown h" is shown enlarged for clarity. Here, the extent of the flat on the crown 2a" is about half the extent of the original flats 2a'. This leads to a crown height h" which is about a factor of four less than h'. If still further reductions in crown heights in the out-of-plane direction are sought, further increases in 2a" relative to 2a' can be employed.

Figure 9:
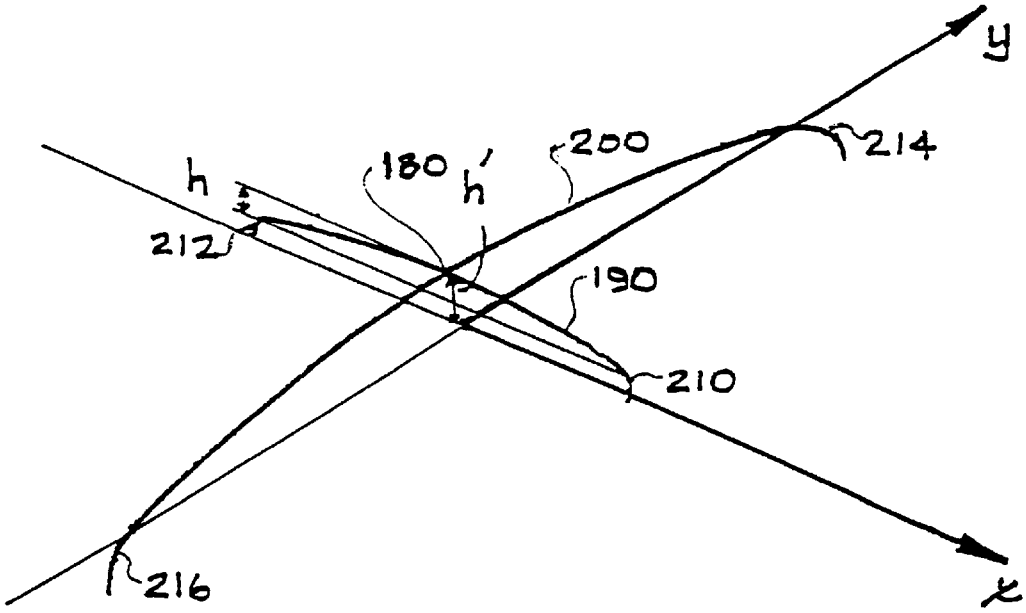
FIG. 9 is a perspective view showing a portion of a contacting surface made in accordance with the present invention.

In combination, the crowning in the in-plane direction of FIG. 6 with that as in FIG. 8(*a*) results in perspective shown in FIG. 9. In FIG. 9, the x-axis is in the in-plane direction while the y-axis is in the out-of-plane direction. That is, the x-axis is in the plane of FIG. 1 and the y-axis in the plane of FIG. 3. A similar perspective applies when crowning in the out-of-plane direction is as in FIG. 8(*b*).

When the flats in the out-of-plane direction are in fact considerably greater than those in the in-plane (i.e., when a'>10a), simple Hertzian contact theory does not fully capture response with crowning as in FIG. 8(*a*). This is because the greater lengths involved introduce bending contributions to deflections. With these additional deflections, the lower bound crown height of Equation 15 no longer ensures that elastic contact extents remain on the circular arc at maximum load. Acceptable crown heights can, however, be determined via finite element analysis. Here, by acceptable, it is meant crown heights h' or h" that ensure elastic contact preferably over at least fifty percent of the original flats on central sections, yet do not have elastic contact spread till its edges are off the circular arc.

The finite element analysis for the out-of-plane section can be two-dimensional as for the in-plane section, thereby avoiding three-dimensional analysis and reducing computation. This is so provided that the loads pressing the disk and blade together in the out-of-plane section are replicated. These loads come from shear force gradients. The loads produced by these gradients can be calculated by the in-plane analysis, then simulated in the out-of-plane analysis by uniform body force fields of the appropriate magnitude. As for the in-plane analysis, the out-of-plane analysis requires implementing capabilities in standard codes which track expanding contact and the use of finite element grids of sufficient resolution to ensure convergence of crowned results.

Figure 10:
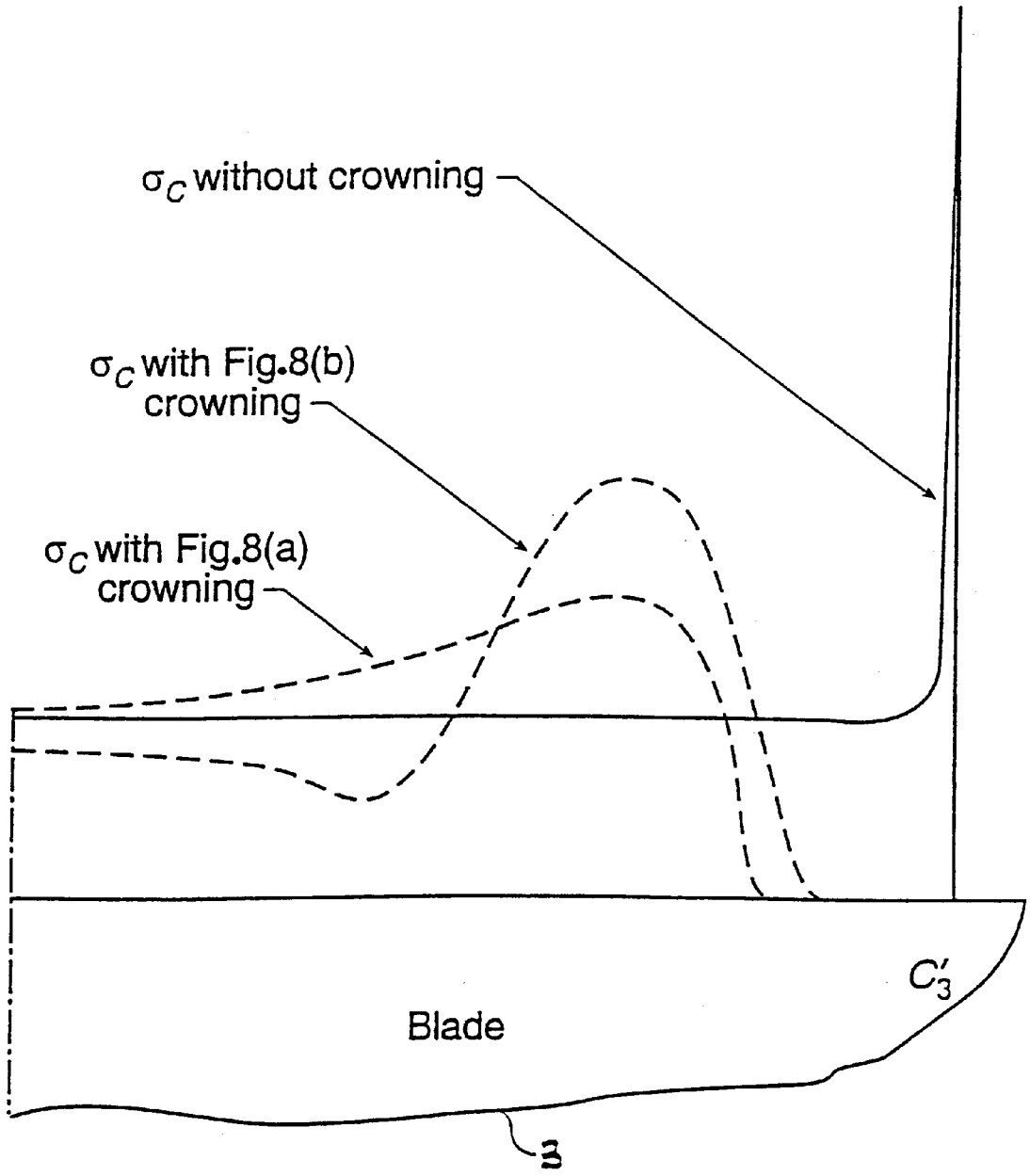
FIG. 10 is a graphic representation of finite element test results for the effects of crowning the central out-of-plane section shown in FIGS. 8(*a*) and 8(*b*).

To test out-of-plane crowning with a profile as in FIG. 8(*a*), an out-of-plane section of a base of a turbine attachment with a flat 2a' of three inches was analyzed. The finite element results showed that a crown height h' of ⅕ inch leads to elastic contact over eighty percent of 2a' The test results also demonstrate how the normal contact stress distribution is improved. For a crown height h'=⅕ inch, the contact stress distributions with and without out-of-plane crowning are shown in FIG. 10. The $\sigma_c$ for the prior art without crowning is shown as a solid line in FIG. 10, while $\sigma_c$ for out-of-plane crowning is shown as a broken line in FIG. 10. Only half of the contact stress distributions is shown in FIG. 10 because these distributions are symmetric. Clearly, the peak $\sigma_c^{max}$ is reduced considerably with crowning. The reduction in $\sigma_c^{max}$ with crowning results from maintaining comparable nominal stresses at maximum load while reducing contributions from stress concentrations.

In all, $\sigma_c^{max}$ with out-of-plane crowning is reduced by more than a factor of 2.9 from the prior art for ⅕ inch crown height in the test results. This leads to the same reduction in peak contact shears via Equation 9, and a similar reduction in peak tensile hoop stress via Equation 10.

Similar test results are found for the same length flat (2a'=3 inch) and a crowning profile as in FIG. 8(*b*). Then, finite element analysis shows that a crown height h"=1/20 leads to elastic contact over eighty-six percent of 2a' when a"=a'/2. Finite element test results are included in FIG. 9. Now the reduction in $\sigma_c^{max}$ is less than for a crowning profile like FIG. 8(*a*), but nonetheless still considerable (being by about a factor of 2.2). This leads to the same reduction in peak contact shears via Equation 9, and to a similar reduction in peak tensile hoop stress via Equation 10.

For crowning in both directions, finite element analysis enables the range of crown heights to be determined so that objectives are met. That is, so that in both in-plane and out-of-plane directions, $K_T$ are reduced, contact occurs over fifty percent or more of central extents but does not spread off circular arcs in crowns, and contact stresses are largely elastic. Finite element analysis can also be used to determine the shape of any noncircular profiles in the out-of-plane direction so that objectives are met.

With appropriate companion analysis, precision crowning can be applied in both directions on either the blade or the disk. It can also be applied on both the blade and the disk. For dovetail attachments, each pair of contact flats for each blade should be crowned by one of the foregoing means. For firtree attachments instead of dovetail, precision crowning can and should be applied on the additional contacting surfaces. Hence, it should now be evident that the present invention reduces tensile hoop stresses at the edge contact of the blades and improves fatigue life of the base of the blades and corresponding disk.

In view of the foregoing and with reference to FIGS. 1–10, the present invention is a blade for a gas turbine for attachment to a rotor disk 5. The present invention is similar to that as described in the prior art except for the crowned contacting surfaces. Hence, like reference numerals will be used for like parts. Referring to FIG. 1, the blade includes an airfoil above line 7, attached to a base of the blade 3, wherein each base of the blade 3 is adapted to be received within a slot defined in the disk 5. A plurality of blades is attached to the disk 5. However, only a portion of one blade is shown in FIG. 1. As shown in FIG. 6, at least one of the bases of the blades 3 has a contacting surface for contacting a corresponding surface of the disk 5, wherein the contacting surface is a crowned or curved contacting surface 100, in lieu of the flat contacting surface 11. A similar crowned or curved surface is provided on the opposite side of the base of the blade 3 in lieu of the flat contacting surface 9. Since the crowned contacting surfaces are similar, only crowned contacting surface 100 will be discussed. The curved surface includes a height 152 from a plane 150 defining a flat. The plane is defined by two orthogonal axes, an x-axis and a y-axis in FIG. 9, wherein the height 152 is defined along an axis normal to the x and y axes. The height 152 varies along the x and y axes.

As shown in FIG. 9, the x-axis extends along the in-plane cross section and the y-axis extends along the out-of-plane cross section so that the contacting surface varies about an in-plane surface and an out-of-plane surface. Preferably, a base contacting surface 100 is defined by circular arcs in both the in-plane and out-of-plane cross sections. More specifically, at least fifty percent of the contacting surface 100 available for contact on central sections is in contact with the corresponding slot contacting surface or disk contacting surface 13 of the disk 5 during maximum loading in normal operation of the blade. It should be noted that the other crowned surface is in contact with the slot contacting surface 15 in a similar manner. As stated previously, the base of the blade 3 can include a plurality of crowned contacting surfaces in place of the flat contacting surfaces 27 and 29, shown in FIG. 2. Preferably, the dimensions of curved contacting surface 100 are determined so that normal operating stresses stay within elastic limits or largely within the elastic limits for areas adjacent the contacting surface 100 of the base of the blade and the contacting surface 13 of the corresponding disk 5. More preferably, the in-plane normal contact stresses act in a Hertzian-like manner during normal operating conditions. A cross section of the out-of-plane contacting surface preferably includes, a single circular arc as shown in FIG. 8(*a*) or two circular arcs 124 positioned on opposite sides of a flat line segment 126 or nearly a flat line segment as shown in FIG. 8(*b*) and as previously described. As shown in FIG. 8(*b*), the line segment 126 extends over 2a". Furthermore, preferably a central height (h' or h") of the out-of-plane curve is such that normal operating stresses in the out-of-plane are within the elastic limits of the blade and the disk.

Referring to FIG. 9, an in-plane profile 190 is along a central section and is taken along the x-axis, and the x-axis extends through a center of the out-of-plane profile. Likewise, an in-plane profile 200 is along a central section and is taken along the y-axis, and the y-axis extends through a center of the in-plane profile. The maximum of the respective profiles 190 and 200 occurs at a common point 180. Further, as stated previously, preferably at least fifty percent of the contacting surfaces along the x-axis and y-axis comes in contact with the respective contacting surface during maximum loading in normal operation of the blade. As can be seen, the profiles 190 and 200 include curved blended ends 210, 212, 214 and 216. It is important to note that these ends 210, 212, 214 and 216 will result in stress concentrations if there is contact made on or near the ends 210, 212, 214 and 216. Therefore, it is preferable that no contact be made between respective contacting surfaces on or near the blended ends 210, 212, 214 and 216.

More specifically, the present invention is a gas turbine engine having a plurality of blades attached to the rotor disk 5 wherein each of the blades includes an airfoil attached to at least one blade of base 3. Each blade of base 3 is adapted to be received in a slot defined by contacting surfaces 13 and 15 of the disk 5. Each respective flat slot and blade of base 3 has a respective flat slot contacting surface 13 and a crowned base contacting surface 100 adapted to contact each other during rotation of the disk 5. Alternatively, the slot contacting surface 13 can be crowned instead of the base contacting surface 100 as previously described or both the base contacting surface and the slot contacting surface can be crowned or curved. Further, the disk contacting surface can be crowned in one direction, e.g., the in-plane direction, and the base contacting surface can be crowned in the other direction, e.g., the out-of-plane direction, and vice versa. In other words, at least one of he respective base contacting surface 100 and the slot contacting surface 13 is curved relative to the other.

The present invention is also a method for manufacturing a gas turbine rotor disk blade base receiving slot and a base of a turbine blade for receipt in the slot, wherein the blade includes an airfoil attached to at least one base, wherein each of the bases is adapted to be received in the respective blade receiving slot defined in the disk, and each respective slot and base having a respective slot contacting surface, such as 13, and a base contacting surface 100 adapted to contact each other during rotation of the disk and wherein at least one of the respective slot contacting surface and the base contacting surface is crowned, the method includes the steps of:

a) performing an in-plane stress analysis and out-of-plane stress analysis of a respective base contacting surface profile and a slot contacting surface profile for a first crown profile;

b) adjusting the crown profile so that under normal operating conditions at maximum load at least fifty percent of the profile for contact in both an in-plane central section and an out-of-plane central section contact the respective base contacting surface or the slot contacting surface, and normal operating stresses of the respective slot contacting surface and base contacting surface are elastic; and c) machining or forming the slot contacting surface and the blade contacting surface pursuant to the adjusted crown profile.

The method can include providing the crown profile on either the slot contacting surface or the blade contacting surface, or providing crown profiles on both the disk contacting surface and the blade contacting surface.

The method can further include providing an in-plane profile and an out-of-plane profile that are defined by circular arcs. The method can further include an in-plane profile that provides in-plane normal contact stresses that act in a Hertzian-like manner under normal operating conditions and the out-of-plane profile can be defined by two circular arcs positioned on opposite ends of a flat line or a nearly flat line. The method can further include defining the profiles using finite element techniques, where the in-plane stress analysis and the out-of-plane stress analysis are performed simultaneously with a three-dimensional stress analysis.

Once the correct profiles of the contacting surfaces are determined, then they can be machined using computer aided design and computer aided machining techniques, that are well known in the art. The remainder of the disk 5 and blade can be designed using designs which are presently known in the art.

Having described the presently preferred embodiments of our invention, it is to be understood that it may otherwise be embodied within the scope of the appended claims.

We claim:

1. A blade for a gas turbine for attachment to a rotor disk, comprising:

an airfoil attached to at least one base, wherein each of the bases is adapted to be received within a slot defined in the disk, at least one of the bases having a contacting surface for contacting a corresponding surface of the disk, wherein the contacting surface includes a curved surface which includes a height from a plane defining a flat surface, wherein the plane is defined by two orthogonal axes and the height is defined along an axis normal to two orthogonal axes, and wherein the height varies along the two orthogonal axes.

2. A blade as claimed in claim 1, wherein the contacting surface varies along an in-plane axis and an out-of-plane axis.

3. A blade as claimed in claim 1, wherein for an in-plane cross section of the contacting surface, the contacting surface extends along an in-plane axis and at least a portion of the contacting surface extending along the in-plane axis is curved, and wherein for an out-of-plane cross section of the contacting surface, the contacting surface extends along an out-of-plane axis normal to the in-plane axis and at least a portion of the contacting surface extending along the out-of-plane axis is curved.

4. A blade as claimed in claim 3, wherein the curved portions of the contacting surface are defined by circular arcs.

5. A blade as claimed in claim 4, wherein at least fifty percent of the contacting surface available for contact on central sections is in contact with the corresponding surface of the disk during maximum loading in normal operation of the blade.

6. A blade as claimed in claim 1, wherein the blade has a plurality of contacting surfaces.

7. A blade as claimed in claim 1, wherein the curved contacting surface is determined so that normal operating stresses stay within elastic limits in the blade and the corresponding disk.

8. A blade as claimed in claim 7, wherein in-plane normal contact stresses act in a Hertzian-like manner.

9. A blade as claimed in claim 4, wherein a cross section of the out-of-plane contacting surface includes two circular arcs positioned on opposite ends of a flat line or nearly flat line.

10. A gas turbine engine having a plurality of blades attached to a rotor disk, wherein each of the blades comprises:

an airfoil attached to at least one base, wherein each of the bases is adapted to be received in a slot defined in the disk, each respective slot and base having a respective slot contacting surface and a base contacting surface adapted to contact each other during rotation of the disk, wherein at least one of the respective base contacting surface and the slot contacting surface is curved relative to the other so that the curved contacting surface includes a height from a plane defining a flat surface, wherein the plane is defined by two orthogonal axes, wherein the height is defined along an axis normal to the two orthogonal axes, and wherein the height varies along both the of the orthogonal axes.

11. The gas turbine engine as claimed in claim 10, wherein one of the base contacting surface and the slot contacting surface is curved.

12. The gas turbine engine as claimed in claim 10, wherein both the base contacting surface and the slot contacting surface are curved.

13. The gas turbine engine as claimed in claim 10, wherein arcs of circles and straight lines or nearly straight lines define profiles of the at least one of the slot contacting surface and the base contacting surface when in-plane and out-of-plane cross sections are taken of the at least one contacting surface.

14. A blade for a gas turbine for attachment to a rotor disk comprising an airfoil attached to at least one base, wherein each of the bases is adapted to be received within a slot defined in the disk, at least one of the bases having a contacting surface for contacting a corresponding surface of the disk, wherein the contacting surface includes a curved surface that includes a height from a plane defining a flat surface, and wherein the plane is defined by two orthogonal axes and the height is defined along an axis normal to the two orthogonal axes and the height varies along one of the axes so that normal operating stresses stay within elastic limits of the blade and the corresponding disk, and normal contact stresses act in a Hertzian-like manner on the central in-plane section.

15. A method for manufacturing a gas turbine rotor disk blade base receiving slot and a base of a turbine blade for receipt in the slot, wherein the blade includes an airfoil attached to at least one base, wherein each of the bases is adapted to be received in the respective blade base receiving slot defined in the disk, and each respective slot and base having a respective slot contacting surface and a base contacting surface adapted to contact each other during rotation of the disk, and wherein at least one of the respective slot contacting surface and the base contacting surface is crowned, the method comprising the steps of:

a) performing an in-plane stress analysis and out-of-plane stress analysis of a respective base contacting surface profile and a slot contacting surface profile for a first crown profile;

b) adjusting the crown profile so that under normal operating conditions at maximum load of at least fifty percent of the profile for contact in both an in-plane central section and an out-of-plane central section contacts the respective base contacting surface or the slot contacting surface, and normal operating stresses of the respective slot contacting surface and base contacting surface are elastic; and c) machining the slot contacting surface and the blade contacting surface pursuant to the adjusted crown profile.

16. The method as claimed in claim 15, wherein the crown profile is provided on at least one of the respective slot contacting surface and the blade contacting surface.

17. The method as claimed in claim 16, wherein the crown profile is provided on both of the slot contacting surface and the blade contacting surface.

18. The method as claimed in claim 15, wherein the crown is defined by an in-plane profile and an out-of-plane profile which include circular arcs.

19. The method as claimed in claim 15, wherein the in-plane profile provides in-plane normal contact stresses that act in a Hertzian-like manner under normal operating conditions.

20. The method as claimed in claim 15, where an out-of-plane profile comprises two circular arcs positioned on opposite sides of a line that is flat or nearly flat.

21. A method as claimed in claim 15, wherein the in-plane stress analysis and the out-of-plane stress analysis are performed simultaneously with a three-dimensional stress analysis.

* * * * *

UNITED STATES PATENT AND TRADEMARK OFFICE

CERTIFICATE OF CORRECTION

PATENT NO. : 6,244,822 B1
DATED : June 12, 2001
INVENTOR(S) : Glenn B. Sinclair et al.

It is certified that error appears in the above-identified patent and that said Letters Patent is hereby corrected as shown below:

Drawings,
Delete Figure 8(b), and substitute therefor the Figure 8(b), as shown on the attached page.

Signed and Sealed this

Fourteenth Day of May, 2002

*Attest:*

*Attesting Officer*

JAMES E. ROGAN
*Director of the United States Patent and Trademark Office*